US011855339B2

(12) United States Patent
Tsuchiya

(10) Patent No.: US 11,855,339 B2
(45) Date of Patent: Dec. 26, 2023

(54) VEHICLE ANTENNA

(71) Applicant: Yazaki Corporation, Tokyo (JP)

(72) Inventor: Kazuhiko Tsuchiya, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 290 days.

(21) Appl. No.: 17/485,738

(22) Filed: Sep. 27, 2021

(65) Prior Publication Data

US 2022/0013887 A1 Jan. 13, 2022

Related U.S. Application Data

(63) Continuation of application No. PCT/JP2020/016574, filed on Apr. 15, 2020.

(30) Foreign Application Priority Data

Apr. 23, 2019 (JP) ..... 2019-081760

(51) Int. Cl.
*H01Q 1/32* (2006.01)
*H01Q 1/12* (2006.01)

(52) U.S. Cl.
CPC ..... *H01Q 1/3275* (2013.01); *H01Q 1/1278* (2013.01)

(58) Field of Classification Search
CPC ..... H01Q 1/3275; H01Q 1/1278; H01Q 13/10
See application file for complete search history.

(56) References Cited

U.S. PATENT DOCUMENTS

2016/0141750 A1 5/2016 Lankes et al.
2018/0145402 A1* 5/2018 Kamioku ..... B60J 7/043

FOREIGN PATENT DOCUMENTS

| | | | |
|---|---|---|---|
| JP | 02-026808 U | | 2/1990 |
| JP | 03-220802 A | | 9/1991 |
| JP | 05-009012 U | | 2/1993 |
| JP | 2004072419 A | * | 3/2004 |
| JP | 3925364 B2 | * | 6/2007 |

* cited by examiner

*Primary Examiner* — Raymond R Chai
(74) *Attorney, Agent, or Firm* — Sughrue Mion, PLLC

(57) ABSTRACT

Provided is a vehicle antenna applied to a vehicle including a sun roof. The vehicle antenna includes a first sun roof forming opening and a second sun roof forming opening exhibiting a rectangular shape and being formed, on a roof of the vehicle, in parallel to have long sides facing each other, the roof being formed of a conductive material, a first power feeding point provided to a long side of the first sun roof forming opening on a facing side, a second power feeding point provided to a long side of the second sun roof forming opening on a facing side, a hot-side conducting wire connected to the first power feeding point, and an earth-side conducting wire connected to the second power feeding point.

2 Claims, 5 Drawing Sheets

VERTICALLY POLARIZED DIRECTIVITY

HORIZONTALLY POLARIZED DIRECTIVITY

VEHICLE ANTENNA

CROSS-REFERENCE TO RELATED APPLICATIONS

The present application is a continuation of International Application No. PCT/JP2020/016574, filed on Apr. 15, 2020, and based upon and claims the benefit of priority from Japanese Patent Application No. 2019-081760, filed on Apr. 23, 2019, the entire contents of which are incorporated herein by reference.

TECHNICAL FIELD

The disclosure relates to a vehicle antenna.

BACKGROUND ART

Japanese unexamined utility model application publication No. H5-9012 discloses a technique of providing an antenna element to a glass lid of a sun roof, which deals with various types of wireless communication systems and devices relating to AM or FM radio broadcasts, the Global Positioning System (GPS), the Electronic Toll Collection System (ETC), the Vehicle Information and Communication System (VICS (registered trademark)), ground wave digital television broadcasts, inter-vehicle communication, and the like.

SUMMARY

However, the automobile antenna causes inconvenience because the antenna pattern formed on the glass lid obstructs a visual field of a passenger.

It is an object of the disclosure to provide a vehicle antenna capable of providing a sun roof with an antenna function without obstructing a visual field of a passenger.

A vehicle antenna according to the disclosure is a vehicle antenna applied to a vehicle including a sun roof. The vehicle antenna includes a sun roof forming opening exhibiting a rectangular shape at one location on a roof of the vehicle, the roof being formed of a conductive material, a first power feeding point provided to one long side of the sun roof forming opening, a second power feeding point provided to another long side of the sun roof forming opening, a hot-side conducting wire connected to the first power feeding point, and an earth-side conducting wire connected to the second power feeding point.

With this, the sun roof formed at the one location of the roof of the vehicle can be provided with an antenna function as a slot antenna without obstructing a visual field of a passenger.

A vehicle antenna according to the disclosure is a vehicle antenna applied to a vehicle including a sun roof. The vehicle antenna includes a first sun roof forming opening and a second sun roof forming opening exhibiting a rectangular shape and being formed, on a roof of the vehicle, in parallel to have long sides facing each other, the roof being formed of a conductive material, a first power feeding point provided to a long side of the first sun roof forming opening on a facing side, a second power feeding point provided to a long side of the second sun roof forming opening on a facing side, a hot-side conducting wire connected to the first power feeding point, and an earth-side conducting wire connected to the second power feeding point.

With this, the sun roofs formed at the two locations of the roof of the vehicle can be provided with an antenna function as a slot antenna without obstructing a visual field of a passenger.

In the vehicle antenna according to the disclosure, the hot-side conducting wire may be connected to one end of a core wire of a co-axial cable laid in the vehicle, the earth-side conducting wire may be connected to an outer cover wire of the co-axial cable, another end of the core wire may be connected to a signal processing device provided to the vehicle, and the outer cover wire may be earth-connected to a conductive portion of the vehicle body.

With this, the simple configuration enables the sun roof to have an antenna function as a slot antenna without obstructing a visual field of a passenger.

According to the disclosure, there can be provided the vehicle antenna capable of providing the sun roof with an antenna function without obstructing a visual field of a passenger.

DESCRIPTION OF EMBODIMENTS

With reference to the drawings, a vehicle antenna according to this embodiment is described below in detail.

With reference to FIG. 1 to FIG. 7, one embodiment of the disclosure is described.

Figure 1:
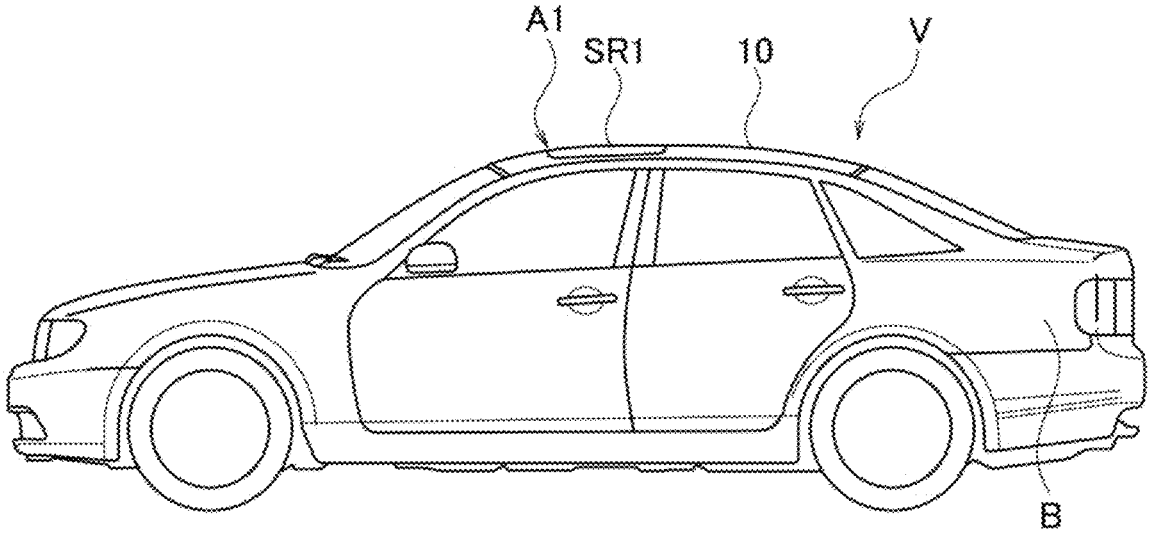
FIG. 1 is a side view illustrating a vehicle on which a vehicle antenna according to a first embodiment is mounted.
Figure 2:
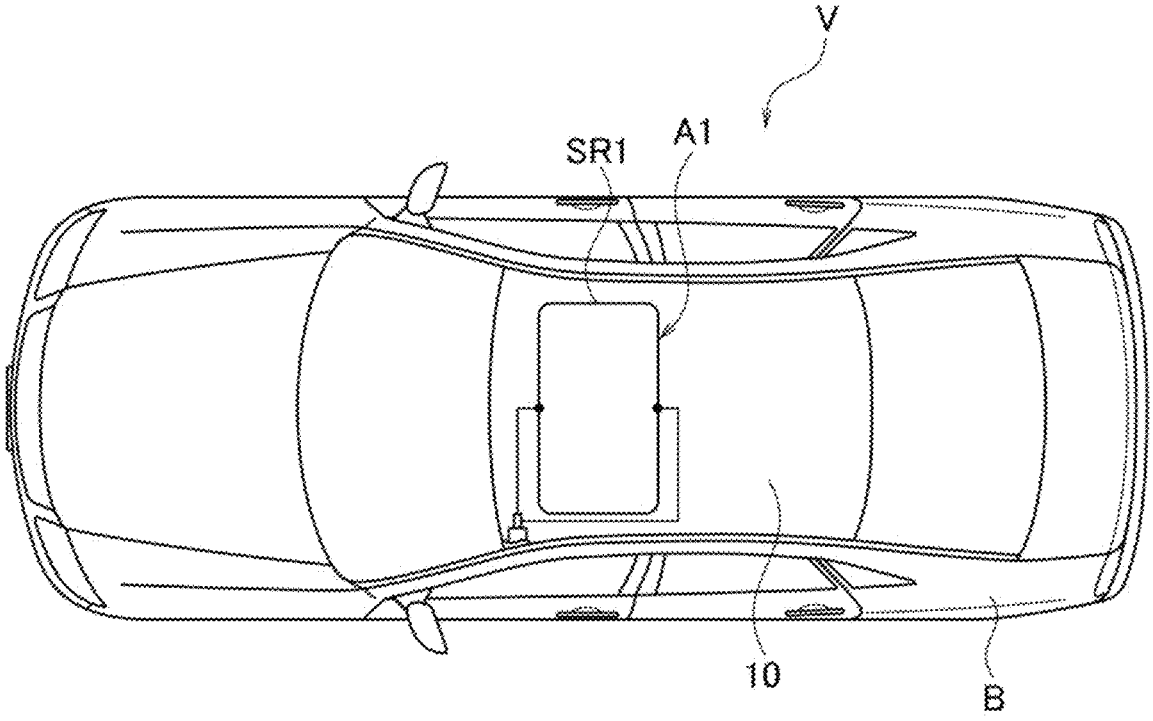
FIG. 2 is a top view illustrating the vehicle on which the vehicle antenna according to the first embodiment is mounted.
Figure 3:
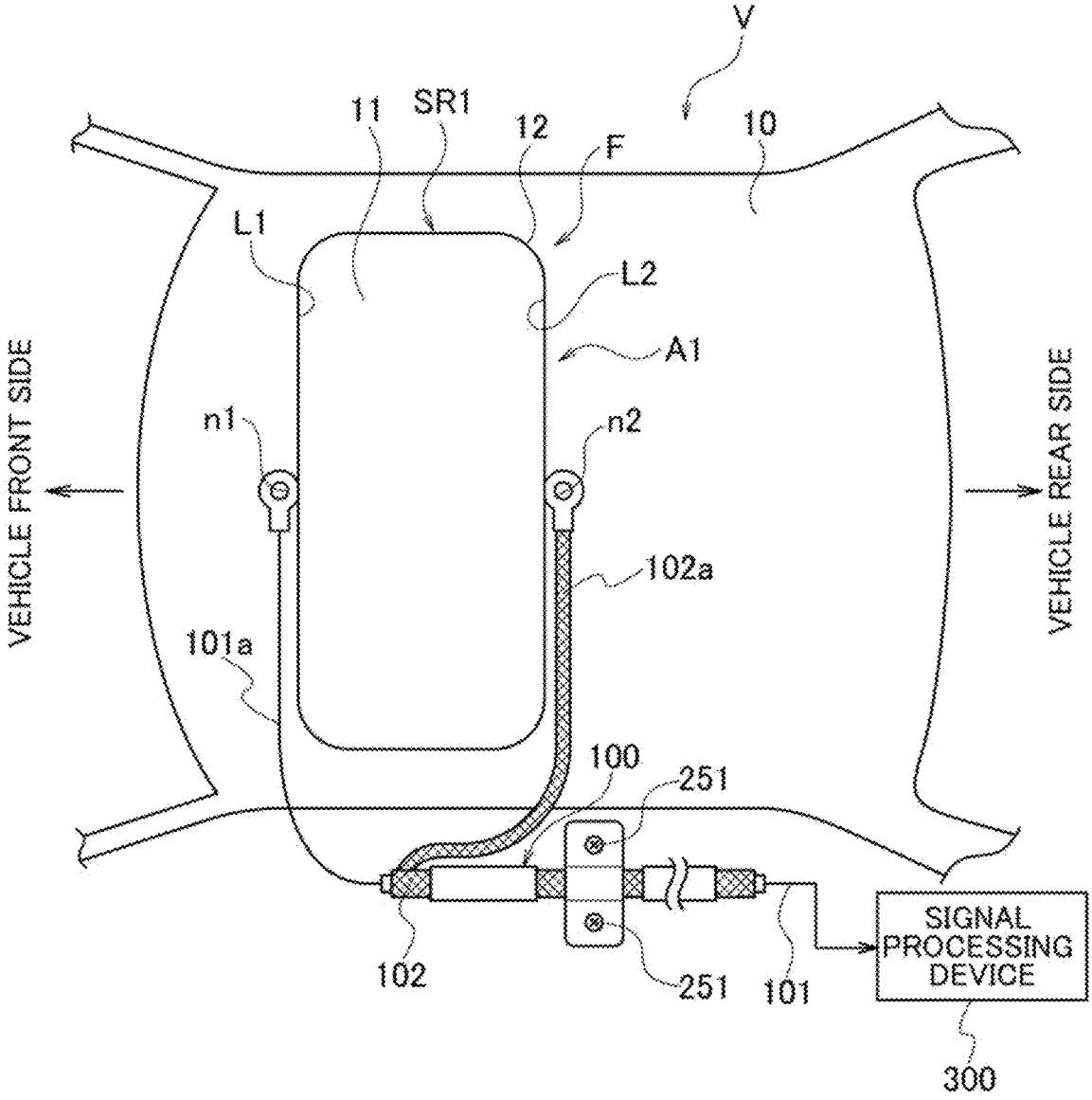
FIG. 3 is a schematic configuration view illustrating a schematic configuration of the vehicle antenna according to the first embodiment.

As illustrated in FIG. 1 to FIG. 3, a sun roof SR1 including a glass lid 11 is provided to a roof (roof section) 10 of a vehicle V.

In this embodiment, the glass lid 11 of the sun roof SR1 is fixed. Alternatively, the glass lid 11 may include a mechanism that slides in a front-rear direction, a right-left direction, or the like.

The roof 10 is formed of a conductive material such as a steel plate, an aluminum plate, and a carbonaceous material.

A sun roof forming opening 12 exhibiting a rectangular shape engageable with the glass lid 11 is formed at one location close to the front side of the roof 10.

A first power feeding point n1 is provided to one long side L1 of the sun roof forming opening 12.

A second power feeding point n2 is provided to the other long side L2 of the sun roof forming opening 12.

A hot-side conducting wire 101*a* is connected to the first power feeding point n1, and an earth-side conducting wire 102*a* is connected to the second power feeding point n2.

Figure 4:
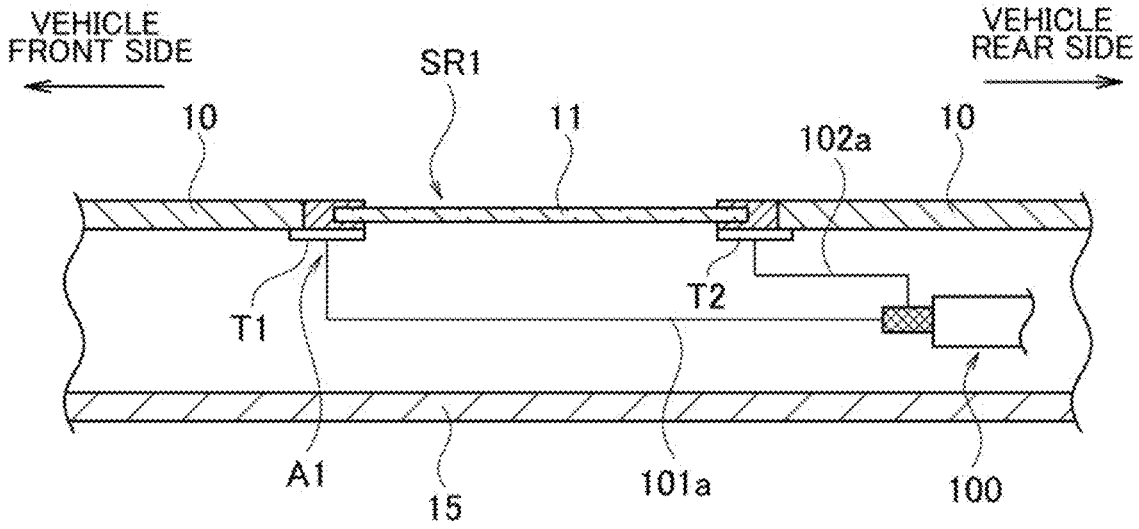
FIG. 4 is a schematic explanatory view illustrating a configuration example of the vehicle antenna according to the first embodiment.

More specifically, as illustrated in FIG. 3 and FIG. 4, the hot-side conducting wire 101*a* is connected to one end of a core wire 101 of a co-axial cable 100 laid in a space formed between the roof 10 and a ceiling plate 15 of the vehicle V.

The earth-side conducting wire 102*a* is connected to an outer cover wire 102 of the co-axial cable 100. The outer cover wire 102 of the co-axial cable 100 is earth-connected to predetermined conductive portion of a vehicle body B by a fixing metal fitting 250 and a screw 251.

The hot-side conducting wire 101*a* and the earth-side conducting wire 102*a* are attached to a vehicle inner side of the roof 10 (a side facing the ceiling plate 15) through intermediation of terminal metal fittings T1 and T2 each having a bolt insertion hole 160.

In order to improve antenna characteristics, it is desired that the hot-side conducting wire 101*a* and the earth-side conducting wire 102*a* have the same length.

Meanwhile, the other end of the core wire 101 is connected to a signal processing device 300 or the like provided to the vehicle V.

Figure 6A:
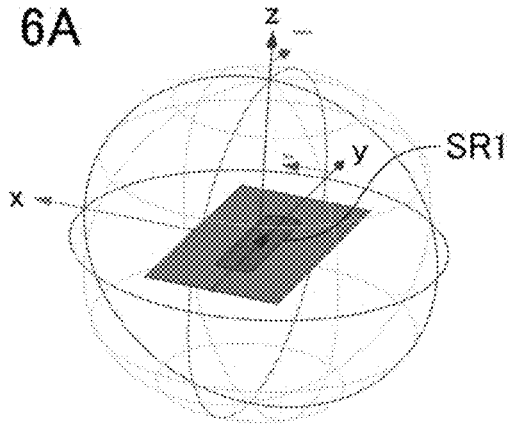
FIG. 6A is a characteristic diagram of the vehicle antenna according to the first embodiment.
Figure 6B:
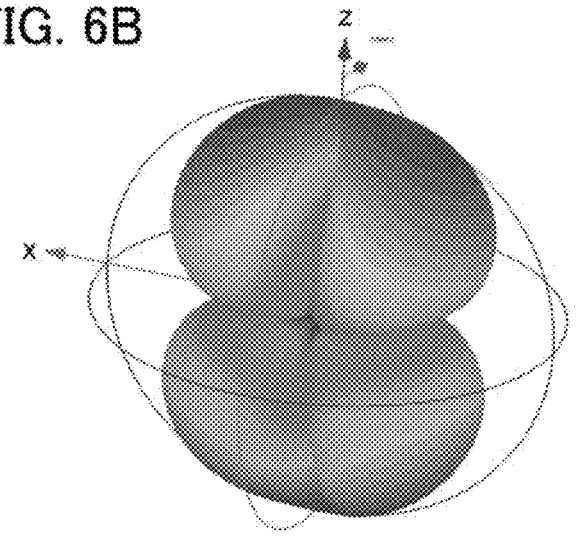
FIG. 6B is a characteristic diagram of the vehicle antenna according to the first embodiment.
Figure 6C:
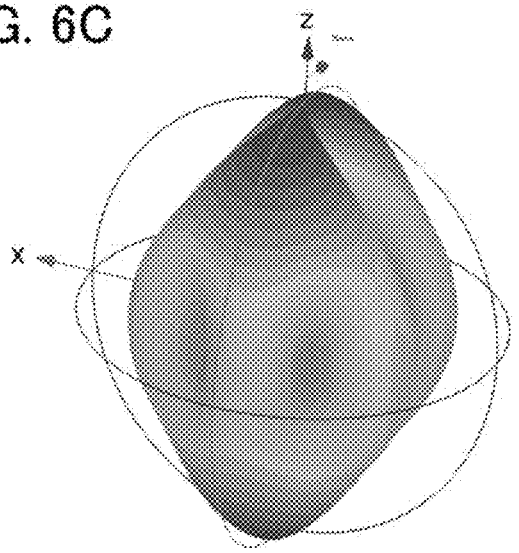
FIG. 6C is a characteristic diagram of the vehicle antenna according to the first embodiment.

A vehicle antenna A1 according to this embodiment has antenna characteristics as illustrated in FIG. 6A to FIG. 6C.

FIG. 6A is a diagram showing orientation of the sun roof SR1 and the like. FIG. 6B is a diagram showing vertically polarized directivity, and FIG. 6C is a diagram showing horizontally polarized directivity.

As described above, with the vehicle antenna A1 according to this embodiment, the sun roof SR1 formed at the one location of the roof 10 of the vehicle can be provided with an antenna function as a slot antenna without obstructing a visual field of a passenger.

Figure 7:
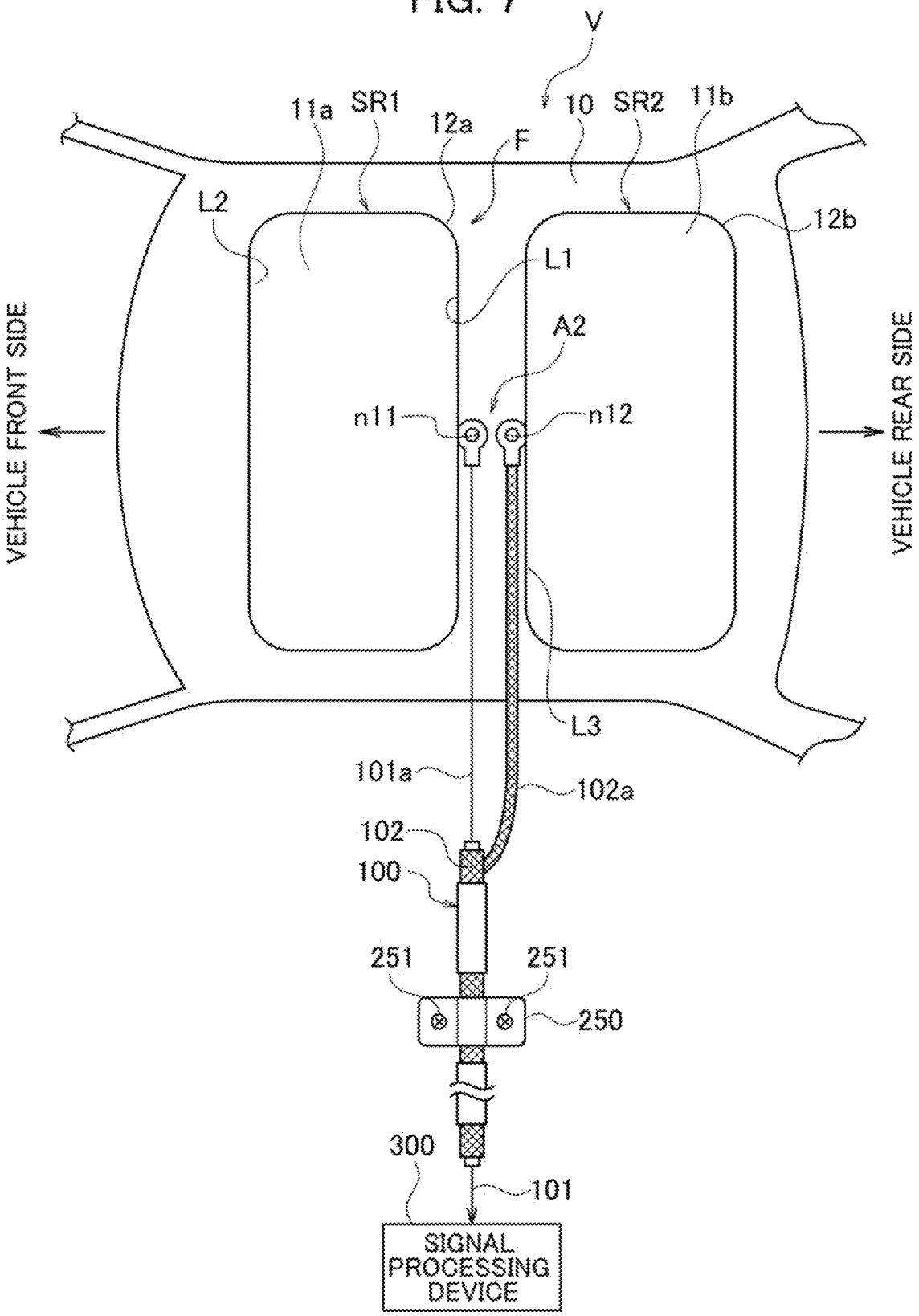
FIG. 7 is a schematic configuration view illustrating a schematic configuration of a vehicle antenna according to a second embodiment.

FIG. 7 is a schematic configuration view illustrating a schematic configuration of a vehicle antenna A2 according to a second embodiment.

As illustrated in FIG. 7, sun roofs SR1 and SR2 including the glass lids 11 are provided at two locations of the roof (roof section) 10 of the vehicle V.

In this embodiment, the glass lids 11*a* and 11*b* of the sun roofs SR1 and SR2 are fixed. Alternatively, the glass lids 11*a* and 11*b* may each include a mechanism that slides in a front-rear direction, a right-left direction, or the like.

The roof 10 is formed of a conductive material such as a steel plate, an aluminum plate, and a carbonaceous material.

A first sun roof forming opening 12*a* exhibiting a rectangular shape engageable with the glass lid 11*a* is formed close to the front side of the roof 10.

A second sun roof forming opening 12*b* exhibiting a rectangular shape engageable with the glass lid 11*b* is formed close to the rear side of the roof 10.

The first sun roof forming opening 12*a* and the second sun roof forming opening 12*b* are formed in parallel to have long sides L1 and L3 facing each other.

A first power feeding point n11 is provided to the long side L1 of the first sun roof forming opening 12*a* on the facing side.

A second power feeding point n12 is provided to the long side L3 of the second sun roof forming opening 12*b* on the facing side.

The hot-side conducting wire 101*a* is connected to the first power feeding point n11.

The earth-side conducting wire 102*a* is connected to the second power feeding point n12.

More specifically, as illustrated in FIG. 7, the hot-side conducting wire 101*a* is connected to the one side of the core wire 101 of the co-axial cable 100 laid in the space formed between the roof 10 and the ceiling plate 15 of the vehicle V.

The earth-side conducting wire 102*a* is connected to the outer cover wire 102 of the co-axial cable 100. The outer cover wire 102 of the co-axial cable 100 is earth-connected to the predetermined conductive portion of the vehicle body B by the fixing metal fitting 250 and the screw 251.

Figure 5:
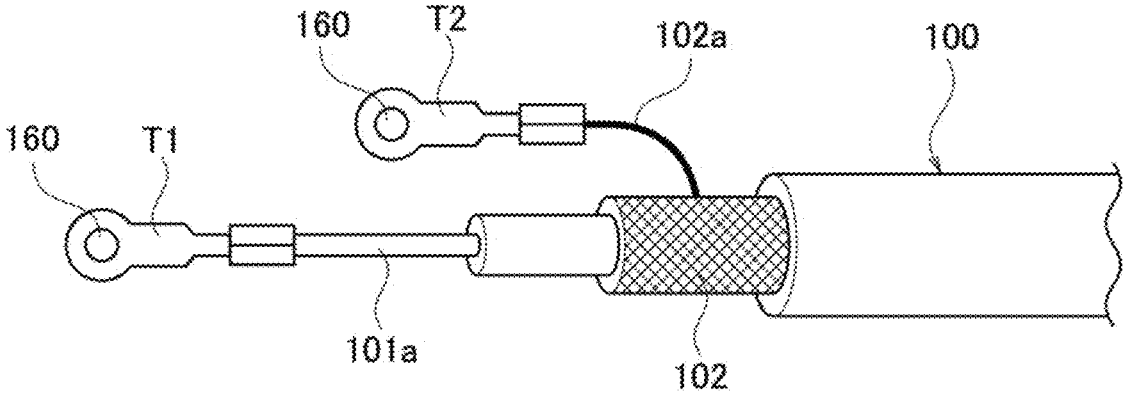
FIG. 5 is a schematic explanatory view illustrating a configuration example of a co-axial cable and a terminal that are applied in the vehicle antenna according to the first embodiment.

As illustrated in FIG. 5 given above, the hot-side conducting wire 101*a* and the earth-side conducting wire 102*a* can be attached to the vehicle inner side of the roof 10 (the side facing the ceiling plate 15) through intermediation of the terminal metal fittings T1 and T2 each having the bolt insertion hole 160.

The other end of the core wire 101 is connected to the signal processing device 300 or the like provided to the vehicle V.

In order to improve antenna characteristics, it is desired that the hot-side conducting wire 101*a* and the earth-side conducting wire 102*a* have the same length.

As described above, with the vehicle antenna A2 according to this embodiment, the sun roofs SR1 and SR2 formed at the roof 10 of the vehicle V can be provided with an antenna function as a slot antenna without obstructing a visual field of a passenger.

The vehicle antenna and the like of the disclosure are described above based on the illustrated embodiments. However, the disclosure is not limited thereto, and the configurations of the respective elements may be replaced with freely-selected configurations having similar functions.

The entire contents of Japanese patent application No. 2019-081760 (filed on Apr. 23, 2019) are herein invoked.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A vehicle antenna applied to a vehicle including a sun roof, the vehicle antenna comprising:

a first sun roof forming opening and a second sun roof forming opening exhibiting a rectangular shape and being formed, on a roof of the vehicle, in parallel to have respective first and second long sides facing each other, the roof being formed of a conductive material;

a first power feeding point provided to the first long side of the first sun roof forming opening;

a second power feeding point provided to the second long side of the second sun roof forming opening;

a hot-side conducting wire connected to the first power feeding point; and an earth-side conducting wire connected to the second power feeding point.

2. The vehicle antenna according to claim 1, wherein the hot-side conducting wire is connected to one end of a core wire of a co-axial cable laid in the vehicle, the earth-side conducting wire is connected to an outer cover wire of the co-axial cable, another end of the core wire is connected to a signal processing device provided to the vehicle, and the outer cover wire is earth-connected to a conductive portion of a vehicle body.

* * * * *